US010399136B2

(12) United States Patent
Joghan et al.

(10) Patent No.: US 10,399,136 B2
(45) Date of Patent: Sep. 3, 2019

(54) CYLINDER HOLDER FOR A HYDROFORMING DEVICE, AND HYDROFORMING DEVICE

(71) Applicants: Faurecia Emissions Control Technologies, Germany GmbH, Augsburg (DE); Technische Universitaet Dortmund, Dortmund (DE)

(72) Inventors: Hamed Dardaei Joghan, Dortmund (DE); Daniel Staupendahl, Dortmund (DE); Andreas Henke, Finnentrop (DE); Thorsten Keesser, Augsburg (DE); Francois Legat, Belfort (FR)

(73) Assignee: Faurecia Emissions Control Technologies, Germany GmbH (DE)

( * ) Notice: Subject to any disclaimer, the term of this patent is extended or adjusted under 35 U.S.C. 154(b) by 54 days.

(21) Appl. No.: 15/712,674

(22) Filed: Sep. 22, 2017

(65) Prior Publication Data

US 2018/0085812 A1 Mar. 29, 2018

(30) Foreign Application Priority Data

Sep. 29, 2016 (DE) ..... 10 2016 118 535

(51) Int. Cl.

| | |
|---|---|
| ***B21D 24/12*** | (2006.01) |
| ***B21D 26/029*** | (2011.01) |
| ***B21D 26/02*** | (2011.01) |
| ***B21D 26/039*** | (2011.01) |
| ***B21D 26/045*** | (2011.01) |
| ***B21D 37/04*** | (2006.01) |

(52) U.S. Cl.

CPC ..... *B21D 24/12* (2013.01); *B21D 26/02* (2013.01); *B21D 26/029* (2013.01); *B21D 26/039* (2013.01); *B21D 26/045* (2013.01); *B21D 37/04* (2013.01)

(58) Field of Classification Search

CPC .... B21D 24/12; B21D 26/039; B21D 26/045; B21D 37/04; B21D 26/02; B21D 26/029

USPC ..... 72/54

See application file for complete search history.

(56) References Cited

U.S. PATENT DOCUMENTS

| | | | | |
|---|---|---|---|---|
| 5,321,964 A * | 6/1994 | Shimanovski | ..... | B21D 26/045 29/421.1 |
| 5,481,892 A * | 1/1996 | Roper | ..... | B21D 9/15 29/421.1 |
| 5,775,153 A * | 7/1998 | Rigsby | ..... | B21D 26/047 29/421.1 |
| 6,732,560 B1 * | 5/2004 | Winterhalter | ..... | B21D 26/045 29/421.1 |

(Continued)

FOREIGN PATENT DOCUMENTS

| | | |
|---|---|---|
| DE | 102013210610 | 12/2014 |
| KR | 1020110031754 | 3/2011 |

*Primary Examiner* — David B Jones

(74) *Attorney, Agent, or Firm* — Carlson, Gaskey & Olds P.C.

(57) ABSTRACT

A cylinder holder for a hydroforming device has a substantially cuboid cylinder holder body with a hydraulic cylinder seat to which a hydraulic cylinder can be fixed. The hydraulic cylinder is configured to supply a hydroforming fluid to a workpiece to be shaped. The cylinder holder further includes a base plate to which the cylinder holder body is fixed at a predetermined angle with an anti-rotation lock unit.

18 Claims, 7 Drawing Sheets

(56) References Cited

U.S. PATENT DOCUMENTS

| | | | | |
|---|---|---|---|---|
| 8,020,419 | B2 * | 9/2011 | Ghiran | B21D 26/047 72/61 |
| 2018/0085812 | A1 * | 3/2018 | Joghan | B21D 24/12 |

* cited by examiner

CYLINDER HOLDER FOR A HYDROFORMING DEVICE, AND HYDROFORMING DEVICE

CROSS-REFERENCE TO RELATED APPLICATIONS

This application claims priority to DE 10 2016 118 535.3, filed Sep. 29, 2016.

FIELD OF THE INVENTION

The present invention relates to a cylinder holder for a hydroforming device, and to a hydroforming device having a cylinder holder.

BACKGROUND

Some hydroforming devices have a substantially cuboid cylinder holder body including a hydraulic cylinder seat to which a hydraulic cylinder can be fixed, and which is configured to supply a hydroforming fluid to a workpiece to be shaped. The hydraulic cylinder seat extends substantially from a first face of the cylinder holder body to a second face, opposite the first face, of the cylinder holder body, and further has a base plate which is arranged on a third face positioned between the first face and the second face.

Hydroforming devices and cylinder holders of this type are known in the prior art and are made use of, in particular, for the hydroforming of tubular bodies within the context of internal high pressure forming (IHPF).

When constructing a hydroforming device, the cylinder holders need to be arranged in a predefined orientation relative to a hydroforming tool. This may be effected on a slotted table, for example.

The required relative orientation between the hydroforming tool and the cylinder holders is ensured here by specially fabricated cylinder holders for the hydroforming tool. That is, as a rule, each hydroforming device requires a set of cylinder holders to be produced. Such cylinder holders are generally produced in one piece.

As a result, construction of a hydroforming device is complicated and time-consuming. This is a drawback in particular in prototype construction because, as a rule, a large number of different orientations of the cylinder holders relative to the hydroforming tool are required here, while each time only small quantities of hydroforming components are manufactured.

The same is true when modular hydroforming tools are used, with the aid of which different components can be produced by the addition or removal of modules.

Against this background, KR 2011 003 1754 discloses a hydroforming device of the type mentioned at the outset, in which the cylinder holders can be positioned substantially freely relative to a hydroforming tool. For this purpose, the cylinder holder is designed in multiple parts. The various cylinder holder parts are displaceable in relation to each other by means of a plurality of tongue-and-groove connections.

It is the object of the invention to further improve adjustable cylinder holders and hydroforming devices having such cylinder holders. In particular, a cylinder holder is to be provided which is adapted to be oriented in relation to a hydroforming tool in a simple manner and, at the same time, can be simply and reliably fixed in a predefined position. The attachment here is intended to be capable of taking up the forces occurring during hydroforming.

SUMMARY

The object is achieved by a cylinder holder that includes a substantially cuboid cylinder holder body including a hydraulic cylinder seat to which a hydraulic cylinder can be fixed, and which is configured to supply a hydroforming fluid to a workpiece to be shaped. The hydraulic cylinder seat extends substantially from a first face of the cylinder holder body to a second face, opposite the first face, of the cylinder holder body, and further has a base plate which is arranged on a third face positioned between the first face and the second face. The base plate includes a device base connection such that the base plate can be fixed to a device base. The cylinder holder body is fixed to the base plate at a predetermined angle with an anti-rotation lock unit. The device base may be a machine table, a foundation, or any other base or bed on which a hydroforming device having a cylinder holder is fixed. The anti-rotation lock unit connects the cylinder holder body with the base plate to prevent relative rotation. The anti-rotation lock unit also provides to the cylinder holder a high mechanical stability because the anti-rotation lock unit is capable of absorbing forces that arise from a hydraulic cylinder seat and of conducting them away into the device base. In this way, a cylinder holder is provided which is at once adjustable and very sturdy.

According to one embodiment, the anti-rotation lock unit includes a projection that is arranged on one of the third face of the cylinder holder body and the base plate, and which is not rotationally symmetrical about an anti-rotation lock axis. The unit includes an opening that geometrically corresponds to the projection, and which is arranged on the other of the cylinder holder body and the base plate, the projection being received in the opening at the predetermined angle. That is, the projection fits precisely into the opening. Here, an interlocking fit is produced between the base plate and the cylinder holder body, both with respect to a rotation about the anti-rotation lock axis and along a cylinder axis of a hydraulic cylinder mounted to the cylinder holder. For different orientations between the cylinder holder and a hydroforming tool, different base plates can be manufactured that each have an opening with a different orientation. Of course, the opening, e.g. in the form of a depression, may also be arranged on the cylinder holder body and the projection may be arranged on the base plate. In this way, the cylinder holder can be adjusted in a simple manner and can at the same time take up large forces.

The projection and the opening may have a substantially polygonal, in particular quadrangular, cross-section. Any other shape that is not rotationally symmetrical is also possible. In this way, it is ensured that the projection and the opening are simple to manufacture. At the same time, in this way the cylinder holder body and the base plate are in surface-to-surface contact with each other, which is of advantage with regard to force introduction. Here, the opening and the projection are designed such that they can engage with each other in only one single orientation (poka-yoke).

Preferably, the opening is arranged substantially obliquely to a lateral edge of the base plate or of the cylinder holder body. More specifically, obliquely here means that the opening is arranged neither parallel nor perpendicularly to the lateral edge of the base plate. Thus, any desired angles of orientation may be realized between the cylinder holder and a hydroforming tool. In particular, in this way, angles may be employed which differ from those of a slot arrangement on a slotted table, for example.

According to a further embodiment, the anti-rotation lock unit comprises a projection that is arranged on one of the third face of the cylinder holder body and the base plate, and which is rotationally symmetrical about an anti-rotation lock axis. The unit includes an opening that geometrically corresponds to the projection, and which is arranged on the other of the cylinder holder body and the base plate, the projection being received in the opening, and the cylinder holder body being clamped to the base plate with a clamping element. This means that the projection and the opening serve to rotationally guide the cylinder holder body relative to the base plate about the anti-rotation lock axis. Thus, any desired angle between these two elements can be selected. In addition, the rotational guide serves to conduct forces that are introduced into the cylinder holder via the hydraulic cylinder. The clamping element or elements act substantially along the anti-rotation lock axis. The elements are made use of to immobilize the cylinder holder body with respect to the base plate. In this way, a cylinder holder is provided which is continuously adjustable about the anti-rotation lock axis, the adjustment being particularly simple.

The clamping element may be bolted to the base plate and a clamping surface on the clamping element side may engage a clamping surface on the cylinder holder body side. By tightening the bolted joint, the clamping action is produced. Loosening the bolted joint allows the cylinder holder body to be rotated relative to the base plate, with the above described rotational guide being made use of in doing so. The clamping surface may also be arranged on the base plate and the clamping element may be bolted to the cylinder holder body. An adjustment mechanism is obtained which can be adjusted using standard tools. In addition, the bolted joint allows a high clamping force to be produced, as a result of which the cylinder holder has a mechanically stable configuration. Further, the bolted joint is comparatively space-saving and easily accessible.

In one variant, the clamping surface on the cylinder holder body side is a lateral surface of a clamping groove, the clamping groove preferably being arranged on a fourth face, positioned between the first, second and third faces, of the cylinder holder body. The clamping surface is thus located spatially inside the cylinder holder body. As a result, the clamping mechanism is very space-saving and the cylinder holder has a very compact design.

Preferably, the fourth face here is substantially a circular cylinder lateral surface portion, arranged with a circular cylinder radius about the anti-rotation lock axis, and the clamping element is substantially arcuate, the arc radius substantially corresponding to the circular cylinder radius. The cylinder holder body can thus be rotated in relation to the base plate about the anti-rotation lock axis as soon as the clamping element has been sufficiently loosened. Therefore, for adjusting the cylinder holder body relative to the base plate, it is not required to remove the clamping element. This ensures that the cylinder holder can be adjusted quickly and with little effort.

The clamping element preferably is a gripping claw. Such clamping elements have been tried and tested many times in the prior art. They are simple to handle and capable of holding the cylinder holder body against the base plate with a sufficiently large clamping force. The gripping claw may be arcuate, as described above. As an alternative, a plurality of narrow gripping claws may also be used, so that they also only need to be loosened for rotating the cylinder holder body in relation to the base plate.

In an additional embodiment, the anti-rotation lock unit comprises a toothing on the cylinder holder body side, arranged on the third face of the cylinder holder body, and a toothing on the base plate side, the two toothings engaging with one another at the predetermined angle. The orientation of the cylinder holder body with respect to the base plate is therefore incrementally adjustable, with one increment being defined by one tooth width. A change in tooth width thus also allows a larger or smaller increment to be realized. The toothing produces an interlocking connection between the cylinder holder body and the base plate, which is capable of absorbing forces with an interlocking fit that are introduced into the cylinder holder in particular by the hydraulic cylinder. The cylinder holder body and the base plate may be additionally bolted to and/or clamped with each other along the anti-rotation lock axis. In this way, a stable and adjustable locking of the cylinder holder body to the base plate is provided.

The toothings on the cylinder holder body side and on the base plate side may be arranged substantially along a toothing circle extending about an anti-rotation lock axis and having a toothing circle radius. That is, the toothings are adapted to a rotating of the cylinder holder body with respect to the base plate. As a result, the adjustment and anti-rotation locking of the cylinder holder body to the base plate is effected particularly simply and quickly.

Preferably, the toothing on the cylinder holder body side is formed by at least one toothing arc segment having the toothing circle radius, and the toothing on the base plate side is formed by at least one toothing arc segment having the toothing circle radius, in particular a closed toothing ring. As an alternative, the toothing ring may be arranged on the cylinder holder body and the toothing segment may be arranged on the base plate. That is, at least one of these elements does not require a completely continuously surrounding toothing thereon. A safe anti-rotation locking is still ensured. This renders the cylinder holder simple and cost-effective to manufacture.

Advantageously, the cylinder holder body comprises a round bottom plate which is received within an interior of the toothing ring. The round bottom plate and the toothing ring together constitute a rotational guide about the anti-rotation lock axis. The rotational adjustment of the cylinder holder body relative to the base plate is particularly simple here, by slightly lifting the two elements off from each other and rotating them relative to each other utilizing the rotational guide. Alternatively, rotation may also be performed in that the teeth of the toothing ring remain in engagement with the teeth in the toothed segment and are rotated in relation to each other while they are substantially forceless in the direction of the anti-rotation lock axis.

Preferably, the toothings are Hirth couplings. Such couplings have stood the test for rotational coupling in various fields of the prior art. The surface contact of the teeth of the Hirth couplings allows large forces to be transferred. This makes the cylinder holder particularly mechanically stable.

A further embodiment provides that the anti-rotation lock unit comprises at least two positioning openings on the cylinder holder body side and arranged on the third face of the cylinder holder body, and at least two positioning openings on the base plate side and arranged on the base plate. Each positioning opening on the cylinder holder body side is associated with a respective positioning opening on the base plate side, and the associated positioning openings are connected with each other by a pin, in particular a dowel pin. The cylinder holder body is thus doweled to the base plate. In this way, a mechanically stable anti-rotation locking is obtained. In the event that dowel pins are used, small tolerances with regard to rotational positioning can be observed by the anti-rotation lock. For a particularly stable anti-rotation locking, the cylinder holder and the base plate may be connected with a plurality of pins.

The at least two positioning openings on each of the cylinder holder body side and the base plate side may be arranged on a respective hole circle having a hole circle radius arranged about the anti-rotation lock axis. The cylinder holder body and the base plate may additionally be connected with a rotational guide that acts about the anti-rotation lock axis. A particularly quick and simple pinned connection and, hence, locking, of the base plate and the cylinder holder body is then ensured.

In one variant, a plurality of positioning openings is arranged at least in sections on the hole circle on the base plate side and/or on the cylinder holder body side, adjacent positioning openings being spaced apart from each other by a hole circle circumference increment. By assigning different positioning openings on the cylinder holder body to a positioning opening of the base plate, or vice versa, different rotational positions of the cylinder holder body relative to the base plate may be set up in this way, with the adjustable rotational positions being predefined by the arrangement of the positioning openings. In this way, a cylinder holder is provided which is adjustable in respect of the rotational position. Here, the hole circle circumference increment corresponds to a rotation angle increment about the anti-rotation lock axis.

In an alternative configuration, in addition to the base plate arranged on the third face, a second base plate is arranged on a face opposite the third face, and the second base plate is fixed to the cylinder holder body at a predetermined angle with an anti-rotation lock unit according to the invention. The cylinder holder body is thus held between two base plates. It may be fixed to the two base plates using anti-rotation lock units of the same type or of different types, with all of the above-mentioned options for rotational locking coming into consideration. This provides an especially stable cylinder holder.

In addition, the object is achieved by a hydroforming device comprising a cylinder holder according to the invention. A hydroforming device of this type may be adapted easily and quickly to different hydroforming tools which require different orientations of the cylinder holder relative to the hydroforming tool. This makes a hydroforming device of this type especially well-suited for prototype fabrication and for cooperation with modular hydroforming tools.

BRIEF DESCRIPTION OF THE DRAWINGS

The invention will be described below with reference to various exemplary embodiments, which are shown in the accompanying drawings, in which.

DETAILED DESCRIPTION

Figure 1:
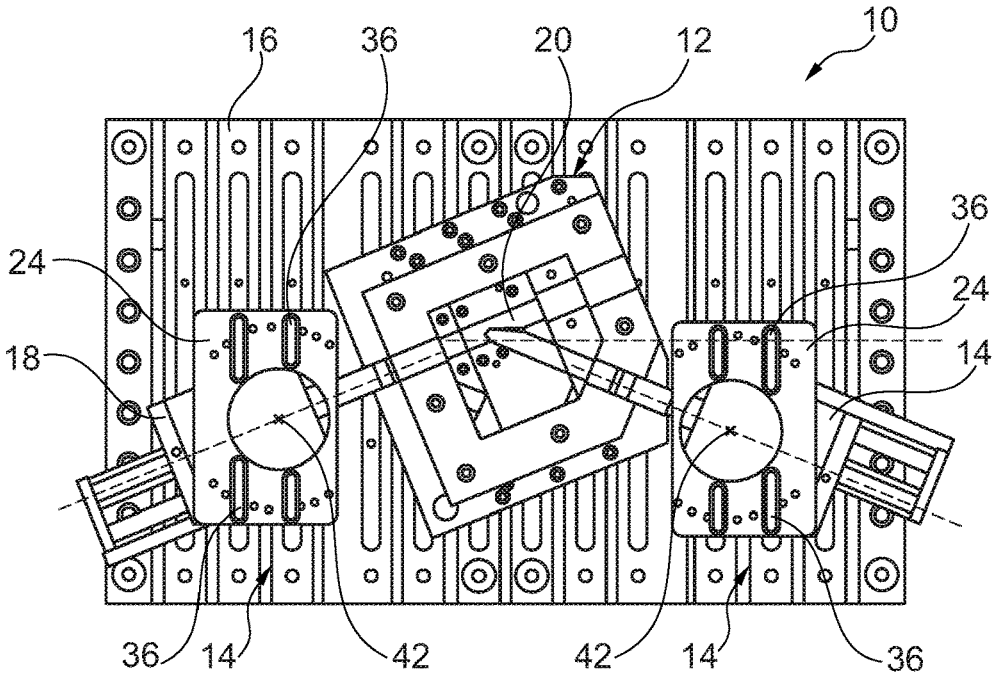
FIG. 1 shows a top view of a hydroforming device according to the invention, with two cylinder holders according to the invention.

FIG. 1 shows a hydroforming device 10 having a hydroforming tool 12 and two cylinder holders 14. The hydroforming device 10 is arranged on a slotted table 16.

Each of the cylinder holders 14 has a hydraulic cylinder 18 held therein. The hydraulic cylinders 18 are configured to supply a hydroforming fluid, not shown in more detail, to a workpiece 20 to be shaped.

The workpiece 20 is arranged within the hydroforming tool 12, which is of a modular design in the embodiment shown.

Each cylinder holder 14 is built up of a substantially cuboid cylinder holder body 22 (FIG. 2), at least one base plate 24. and an anti-rotation lock unit 26.

Figure 2:
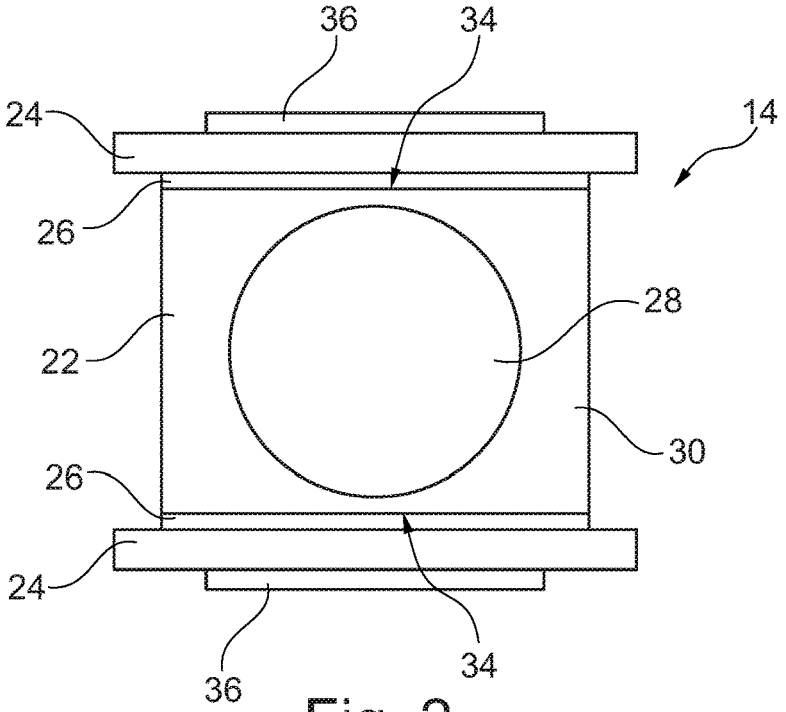
FIG. 2 shows a schematic view of a cylinder holder according to the invention.

In the embodiment illustrated in FIG. 2, the cylinder holder 14 comprises two base plates 24 and two associated anti-rotation lock units 26. The cylinder holder body 22 is fixed to the base plates 24 at a predefined angle with the anti-rotation lock units 26.

A hydraulic cylinder seat 28 for fixing the associated hydraulic cylinder 18 is arranged within the cylinder holder body 22 (see FIG. 1).

The hydraulic cylinder seat 28 here extends from a first face 30 of the cylinder holder body 22 up to a second face 32 (FIG. 3) of the cylinder holder body 22, the second face 32 being opposite the first face 30. The base plates 24 are each arranged on a third face 34 which is positioned between the first face 30 and the second face 32. In the event that the cylinder holder 14 comprises two base plates, these are arranged on opposite third faces 34.

Furthermore, each base plate 24 comprises a device base connection 36 by which the base plate 24 can be fixed to a device base, for example the slotted table 16.

Figure 3:
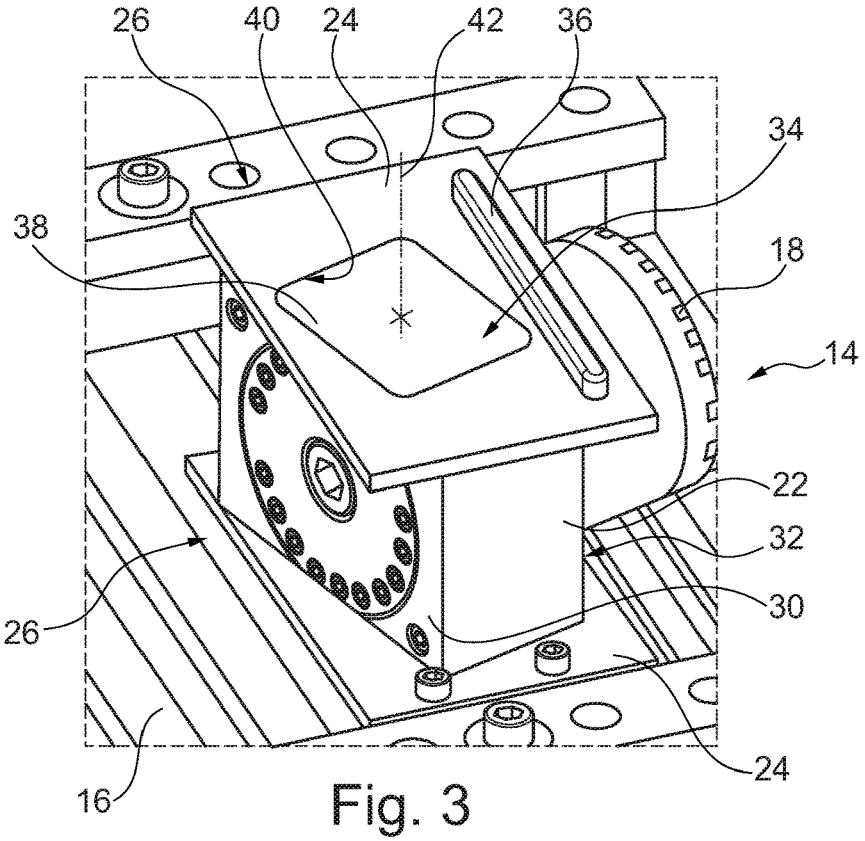
FIG. 3 shows a perspective view of a cylinder holder according to a first embodiment of the invention.
Figure 4:
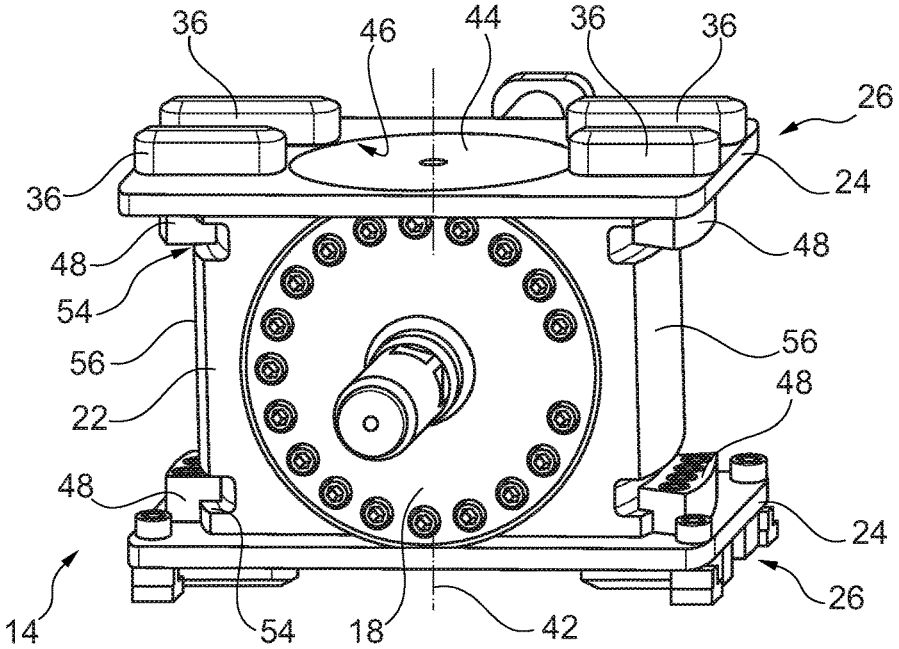
FIG. 4 shows a perspective view of a cylinder holder according to a second embodiment of the invention.
Figure 5:
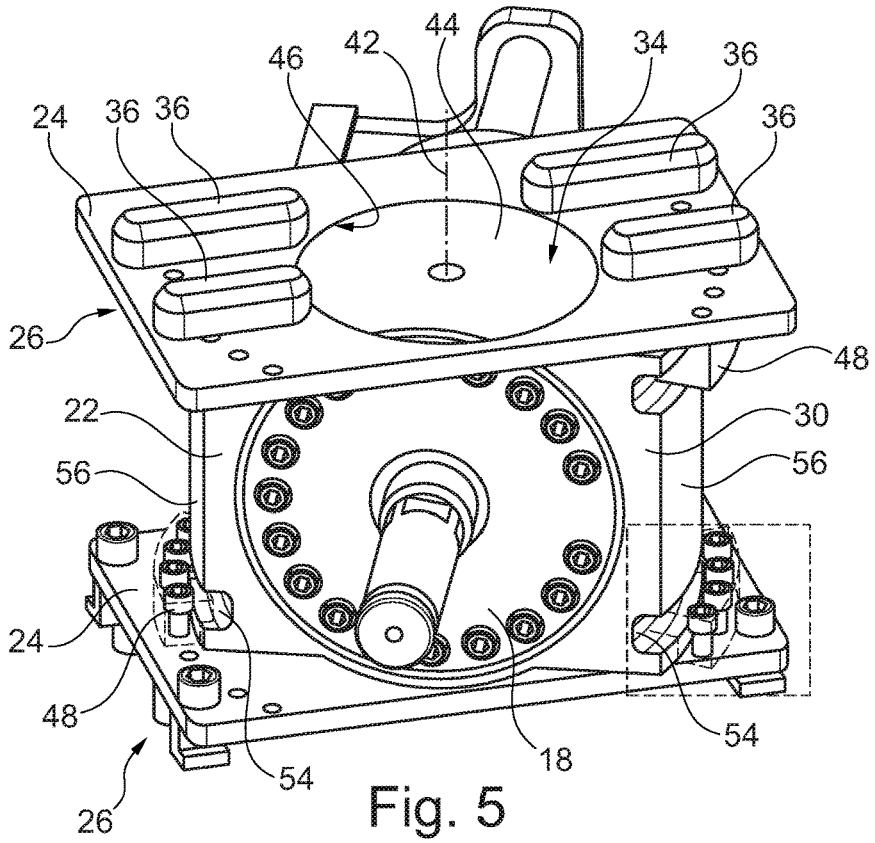
FIG. 5 shows a further perspective view of a cylinder holder according to the second embodiment of the invention.
Figure 6:
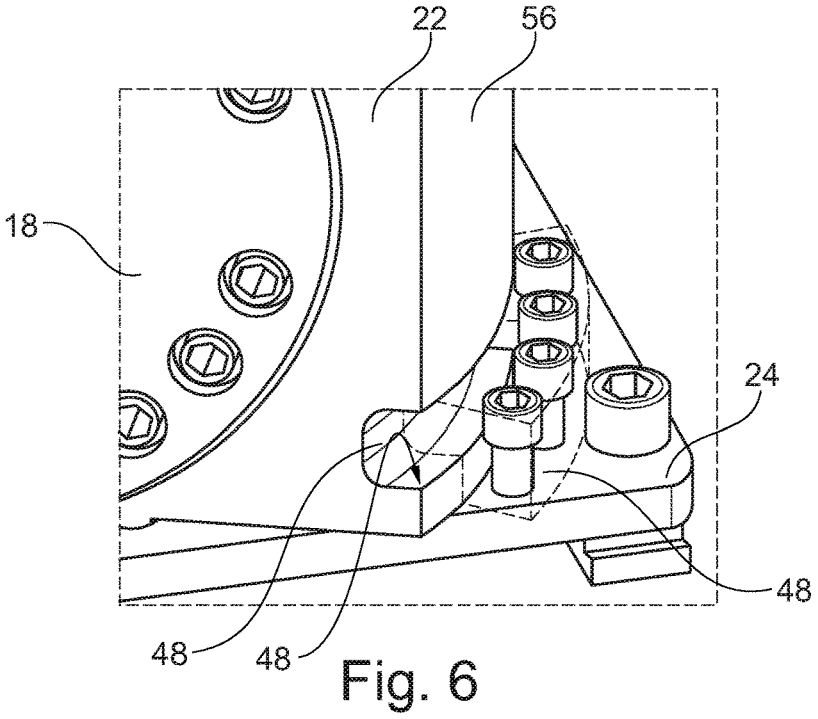
FIG. 6 shows a detail from FIG. 5 of the cylinder holder according to the invention.
Figure 7:
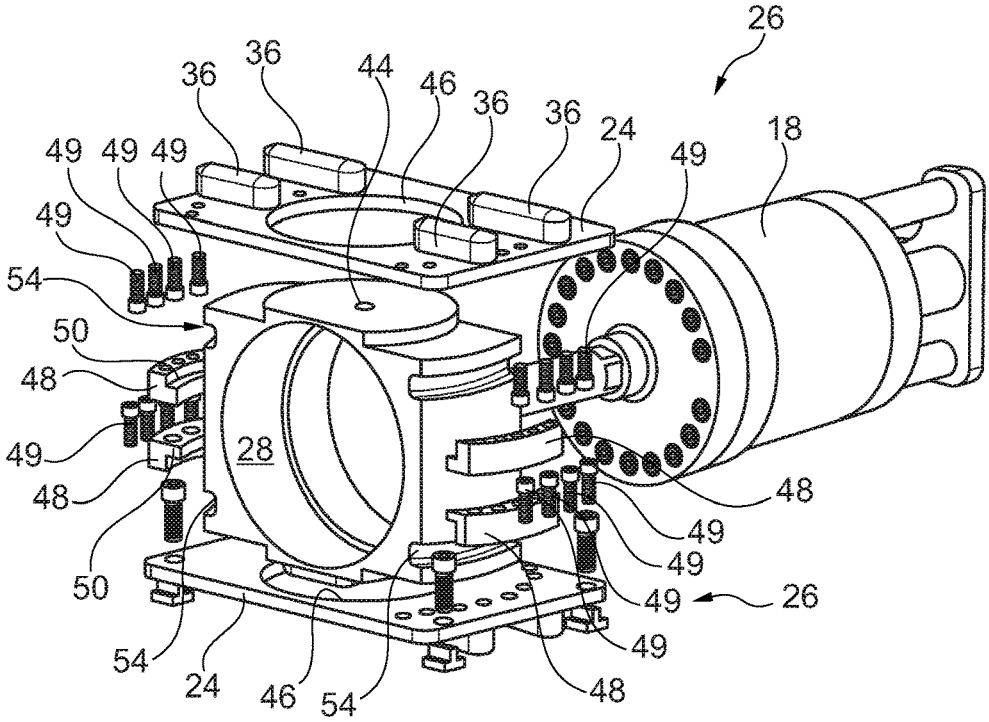
FIG. 7 shows an exploded illustration of a cylinder holder according to the second embodiment of the invention.
Figure 8:
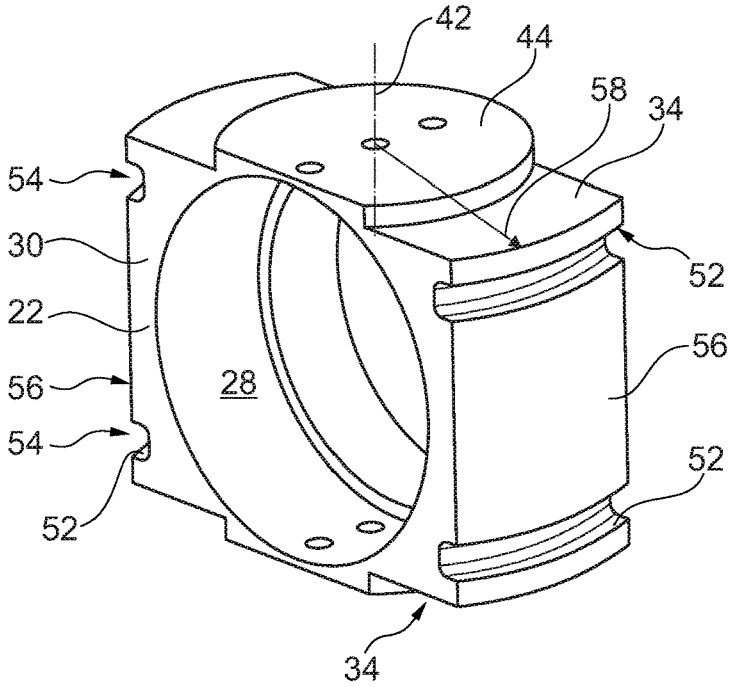
FIG. 8 shows a perspective view of a cylinder holder body of a cylinder holder according to the second embodiment of the invention.
Figure 9:
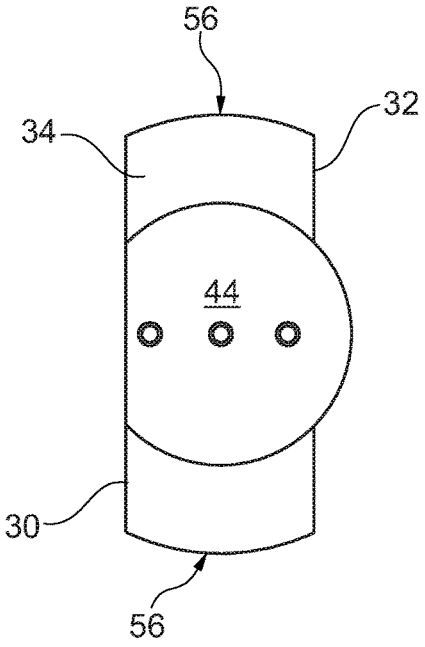
FIG. 9 shows a top view of a cylinder holder body of a cylinder holder according to the second embodiment of the invention.
Figure 10:
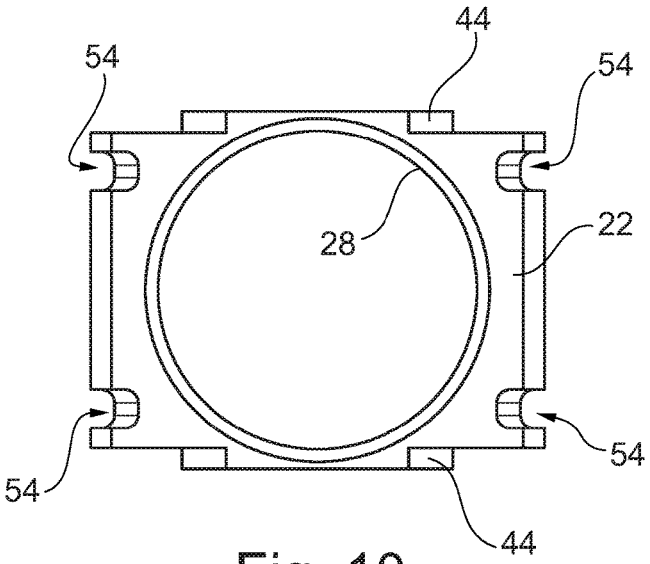
FIG. 10 shows a side view of a cylinder holder body of a cylinder holder according to the second embodiment of the invention.
Figure 11:
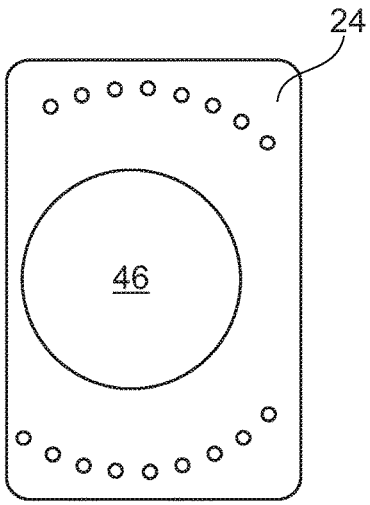
FIG. 11 shows an upper base plate of a cylinder holder according to the second embodiment of the invention.
Figure 12:
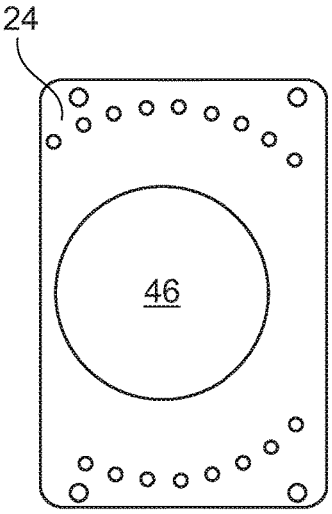
FIG. 12 shows a lower base plate of a cylinder holder according to the second embodiment of the invention.

FIG. 3 shows a first embodiment of the cylinder holder 14.

In this embodiment, the anti-rotation lock unit 26 comprises a substantially quadrangular projection 38 which is arranged on the third face 34 of the cylinder holder body 22. The projection 38 engages into a geometrically corresponding opening 40. The opening 40 is realized in the base plate 24.

Neither the opening 40 nor the projection 38 is rotationally symmetrical with respect to an anti-rotation lock axis 42.

By the projection 38 being received within the opening 40, the cylinder holder body 22 may be arranged at a predetermined angle relative to the base plate 24. In particular, the opening 40 is arranged obliquely to a lateral edge of the base plate 24. Any desired predetermined angle may be realized by the arrangement of the opening 40 in the base plate 24.

Alternatively, the projection 38 may, of course, also be arranged on the base plate 24, and the opening 40, for example in the form of a depression, may be arranged in the cylinder holder body 22.

For an implementation of different angles between the base plate 24 and the cylinder holder body 22, in the illustrated embodiment different base plates 24 may be produced which differ in the arrangement of the opening 40 in relation to the anti-rotation lock axis 42.

If it is intended to change the angle between the base plate 24 and the cylinder holder body 22, the base plate 24 needs to be exchanged.

The base plates 24 are bolted to the cylinder holder body 22.

The first embodiment of the cylinder holder 14 comprises two base plates 24 and two associated anti-rotation lock units 26. It is, of course, also possible that the cylinder holder 14 includes only one single base plate 24 and one single associated anti-rotation lock unit 26.

FIGS. 4 to 12 illustrate a second embodiment of the cylinder holder 14.

In this embodiment, the anti-rotation lock unit 26 comprises a projection 44 which is rotationally symmetrical with respect to the anti-rotation lock axis 42 and is arranged on the cylinder holder body 22. The projection 44 is arranged within an opening 46 which is likewise rotationally symmetrical about the anti-rotation lock axis 42 and is provided in the base plate 24.

The projection 44 and the opening 46 therefore constitute a rotational guide, by which the cylinder holder body 22 can be rotated relative to the base plate 24.

The cylinder holder body 22 is additionally clamped to the base plate 24. To this end, clamping elements 48 are used, which in the illustrated embodiment are in the form of gripping claws.

In the embodiment shown, the cylinder holder 14 comprises two base plates 24, each of which is clamped to the cylinder holder body 22 with two clamping elements 48. Each of the clamping elements 48 is bolted to the associated base plate 24 with bolts 49, for example.

A clamping surface 50 (see FIG. 7) on the clamping element side engages a clamping surface 52 on the cylinder holder body side. Here, the clamping surface 52 on the cylinder holder body side is a lateral surface of a clamping groove 54 which is arranged on a fourth face 56 of the cylinder holder body 22.

The fourth face 56 is positioned between the first face 30, the second face 32, and the third face 34.

The fourth face 56, more particularly, is not flat here, but is a circular cylinder lateral surface portion which is arranged with a circular cylinder radius 58 about the anti-rotation lock axis 42. Furthermore, the clamping elements 48 are substantially arcuate, the arc radius substantially corresponding to the circular cylinder radius 58.

For adjusting the angle between the base plate 24 and the cylinder holder body 22, in this embodiment the clamping elements 48 need to be loosened by untightening the bolts 49.

The cylinder holder body 22 can then be rotated in relation to the base plate 24, utilizing the rotational guide formed by the projection 44 and the opening 46.

As soon as the predefined angle between the cylinder holder body 22 and the base plate 24 has been set, the bolts 49 are tightened. The cylinder holder body 22 is then fixed to the base plate 24 with the clamping elements 48. The angle may be continuously adjustable.

A cylinder holder 14 is shown here which comprises two base plates 24 and two associated anti-rotation lock units 26. But it is just as conceivable that the cylinder holder 14 has only one base plate 24 and one associated anti-rotation lock unit 26.

Figure 13:
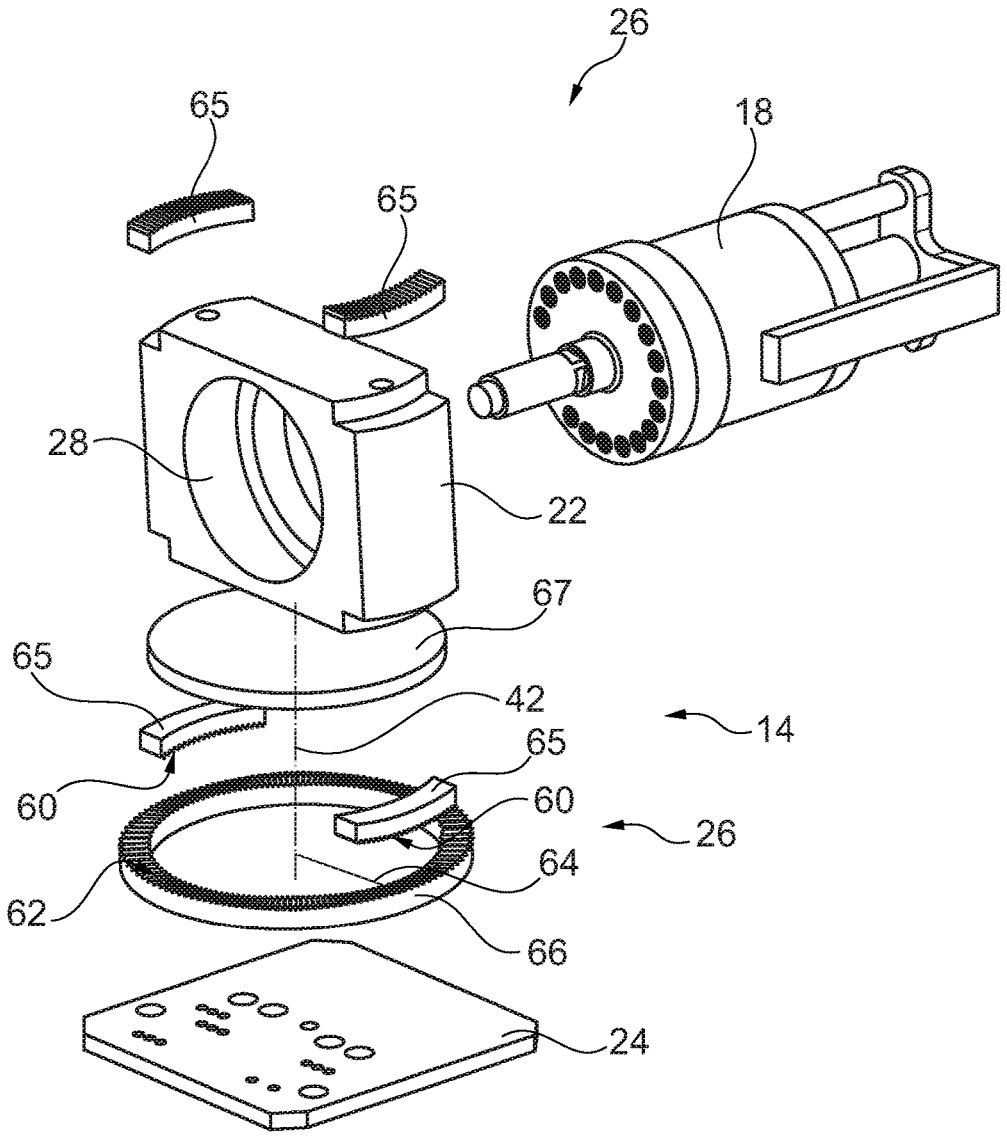
FIG. 13 shows an exploded illustration of a cylinder holder according to a third embodiment of the invention.

FIG. 13 shows a third embodiment of the cylinder holder 14.

In this embodiment the anti-rotation lock unit 26 comprises a toothing 60 on the cylinder holder body side and a toothing 62 on the base plate side. The two toothings 60, 62 engage with each other at a predetermined angle.

Here, the toothings 60, 62 are arranged substantially along a toothing circle extending about the anti-rotation lock axis 42 and having a toothing circle radius 64.

The toothing 60 on the cylinder holder body side is formed by two toothing arc segments 65 having the toothing circle radius 64.

The toothing 62 on the base plate side comprises a closed toothing ring 66, which likewise has the toothing circle radius 64.

In addition, the cylinder holder body 22 has a round bottom plate 67 arranged thereon, which in the mounted condition is received within an interior of the toothing ring 66 which forms the toothing 62 on the base plate side. In this way, a rotational guide is produced between the cylinder holder body 22 and the base plate 24.

Both the toothing 60 on the cylinder holder body side and the toothing 62 on the base plate side may be configured as so-called "Hirth couplings."

The cylinder holder body 22 and the base plate 24 may additionally be fixed against each other in the direction of the anti-rotation lock axis 42, e.g. by bolts or gripping claws. This is not illustrated in FIG. 13.

The predefined angle between the base plate 24 and the cylinder holder body 22 may be effected by rotating the toothing arc segments 65 in relation to the toothing ring 66.

In doing so, the tooth width used determines the pitch, that is, the increments by which the rotation can take place.

To adjust the predefined angle, the base plate 24 needs to be slightly lifted off from the cylinder holder body 22.

In the embodiment shown in FIG. 13, the cylinder holder 14 comprises two base plates 24 and two anti-rotation lock units 26. For reasons of clarity, however, the upper base plate 24, the upper toothing ring 66 and the upper bottom plate 67 are not illustrated.

Figure 14:
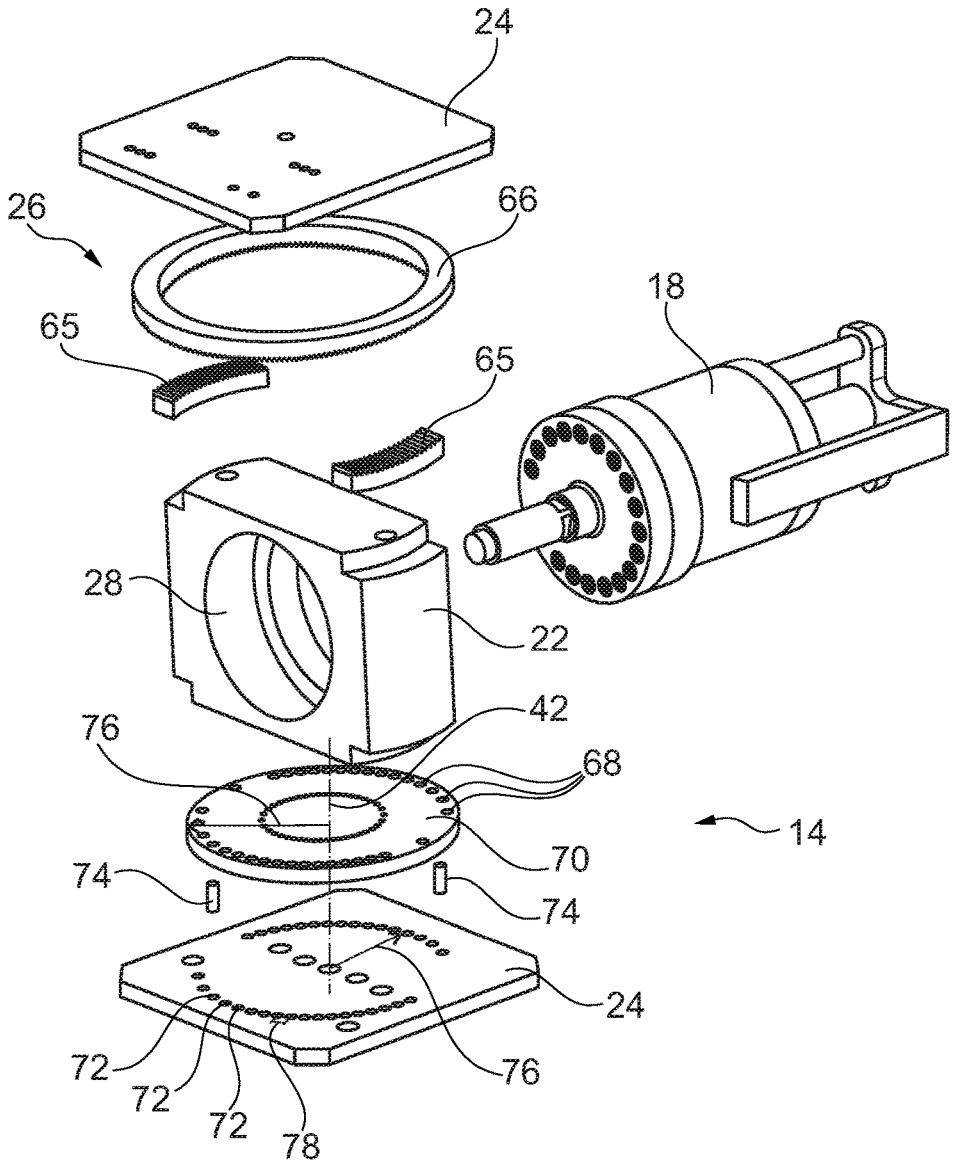
FIG. 14 shows an exploded illustration of a cylinder holder according to a fourth embodiment of the invention.

FIG. 14 shows a fourth embodiment of the cylinder holder 14.

In this embodiment, the cylinder holder 14 comprises two different anti-rotation lock units 26.

The anti-rotation lock unit 26 shown in the top portion of FIG. 14 here corresponds to the anti-rotation lock unit 26 from FIG. 13. Reference is made to the above explanations in this respect.

The anti-rotation lock unit 26 illustrated in the bottom portion of FIG. 14 comprises a plurality of positioning openings 68 on the cylinder holder body side. The positioning openings 68 are arranged in a bottom plate 70, which is firmly connected with the cylinder holder body 22.

Furthermore, positioning openings 72 on the base plate side are arranged in the base plate 24.

Here, at least one of the positioning openings 68 on the cylinder holder body side is assigned to one of the positioning openings 72 on the base plate side and is connected with a pin 74. The base plate 24 and the bottom plate 70 and therefore the cylinder holder body 22 are thus connected with, or more precisely, pinned to, each other at a predetermined angle about the anti-rotation lock axis 42.

In the embodiment shown, two pins 74 are used.

The positioning openings 72 on the base plate side here are located on a hole circle oriented about the anti-rotation lock axis 42 and having a hole circle radius 76.

The same applies to the positioning openings 68 arranged in the bottom plate 70. The hole circles each comprise a plurality of positioning openings 68, 72, with neighboring positioning openings being spaced apart from each other by a hole circle circumference increment 78.

In order to adjust a predefined angle between the base plate 24 and the cylinder holder body 22, the base plate 24 and the cylinder holder body 22 with the bottom plate 70 are therefore positioned in relation to each other such that at least one positioning opening 72 on the base plate side and at least one positioning opening 68 on the cylinder holder body side are positioned one above the other and can be connected by the pin 74.

To change the angle between the base plate 24 and the cylinder holder body 22, the pin 74 is removed from at least one of the positioning openings 68, 72 and, after the desired angle has been adjusted, is inserted into appropriate positioning openings 68, 72 again.

As could be seen from the Figures, the cylinder holder 14 may comprise one or two base plates 24. The number of anti-rotation lock units 26 corresponds to the number of base plates 24 here. In a cylinder holder 14 having two anti-rotation lock units 26, the illustrated embodiments of the anti-rotation lock unit 26 may be combined as desired.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A cylinder holder for a hydroforming device, comprising:

a substantially cuboid cylinder holder body which comprises a hydraulic cylinder seat to which a hydraulic cylinder can be fixed which is configured to supply a hydroforming fluid to a workpiece to be shaped, the hydraulic cylinder seat extending substantially from a first face of the cylinder holder body to a second face, opposite the first face, of the cylinder holder body;

a base plate is arranged on a third face positioned between the first face and the second face, wherein the base plate comprises a device base connection to fix the base plate to a device base, and wherein the cylinder holder body is fixed to the base plate at a predetermined angle with an anti-rotation lock unit; and wherein the anti-rotation lock unit comprises a projection which is arranged on one of the third face of the cylinder holder body and the base plate, and is not rotationally symmetrical about an anti-rotation lock axis, and an opening which geometrically corresponds to the projection and is arranged on the other of the cylinder holder body and the base plate, the projection being received in the opening at the predetermined angle.

2. The cylinder holder of claim 1 wherein the projection and the opening have a substantially polygonal, in particular quadrangular, cross-section.

3. The cylinder holder according to claim 1 wherein the opening is arranged substantially obliquely to a lateral edge of the base plate or of the cylinder holder body.

4. The cylinder holder of claim 1 wherein, in addition to the base plate arranged on the third face, a second base plate is arranged on a face opposite the third face, and the second base plate is fixed to the cylinder holder body at a predetermined angle with an anti-rotation lock unit, the anti-rotation lock unit comprising a projection which is arranged on one of the third face of the cylinder holder body and the base plate and is not rotationally symmetrical about an anti-rotation lock axis, and an opening which geometrically corresponds to the projection and is arranged on the other of the cylinder holder body and the base plate, the projection being received in the opening at the predetermined angle.

5. A cylinder holder for a hydroforming device, comprising:

a substantially cuboid cylinder holder body which comprises a hydraulic cylinder seat to which a hydraulic cylinder can be fixed which is configured to supply a hydroforming fluid to a workpiece to be shaped, the hydraulic cylinder seat extending substantially from a first face of the cylinder holder body to a second face, opposite the first face, of the cylinder holder body;

a base plate is arranged on a third face positioned between the first face and the second face, wherein the base plate comprises a device base connection to fix the base plate to a device base, and wherein the cylinder holder body is fixed to the base plate at a predetermined angle with an anti-rotation lock unit; and wherein the anti-rotation lock unit comprises a projection which is arranged on one of the third face of the cylinder holder body and the base plate, and is rotationally symmetrical about an anti-rotation lock axis, and an opening which geometrically corresponds to the projection and is arranged on the other of the cylinder holder body and the base plate, the projection being received in the opening, and the cylinder holder body being clamped to the base plate with a clamp, wherein the clamp is bolted to the base plate and a clamping surface on a clamp side engages a clamping surface on the cylinder holder body side.

6. The cylinder holder of claim 5 wherein the clamping surface on the cylinder holder body side is a lateral surface of a clamping groove, the clamping groove being arranged on a fourth face positioned between the first, second, and third faces of the cylinder holder body.

7. The cylinder holder of claim 6 wherein the fourth face is substantially a circular cylinder lateral surface portion, arranged with a circular cylinder radius about the anti-rotation lock axis, and the clamp is substantially arcuate, an arc radius substantially corresponding to the circular cylinder radius.

8. The cylinder holder of claim 5 wherein the clamp is a gripping claw.

9. The cylinder holder of claim 5 wherein, in addition to the base plate arranged on the third face, a second base plate is arranged on a face opposite the third face, and the second base plate is fixed to the cylinder holder body at a predetermined angle with an anti-rotation lock unit, the anti-rotation lock unit comprising a projection which is arranged on one of the third face of the cylinder holder body and the base plate and is not rotationally symmetrical about an anti-rotation lock axis, and an opening which geometrically corresponds to the projection and is arranged on the other of the cylinder holder body and the base plate, the projection being received in the opening at the predetermined angle.

10. A hydroforming device comprising:

a cylinder holder according to claim 5.

11. A cylinder holder for a hydroforming device, comprising:

a substantially cuboid cylinder holder body which comprises a hydraulic cylinder seat to which a hydraulic cylinder can be fixed which is configured to supply a hydroforming fluid to a workpiece to be shaped, the hydraulic cylinder seat extending substantially from a first face of the cylinder holder body to a second face, opposite the first face, of the cylinder holder body;

a base plate is arranged on a third face positioned between the first face and the second face, wherein the base plate comprises a device base connection to fix the base plate to a device base, and wherein the cylinder holder body is fixed to the base plate at a predetermined angle with an anti-rotation lock unit; and wherein the anti-rotation lock unit comprises a first toothing on the cylinder holder body side, arranged on the third face of the cylinder holder body, and a second toothing on the base plate side, the first and second toothings engaging with one another at the predetermined angle.

12. The cylinder holder of claim 11 wherein the toothings on the cylinder holder body side and on the base plate side are arranged substantially along a toothing circle extending about an anti-rotation lock axis and having a toothing circle radius.

13. The cylinder holder of claim 12 wherein the toothing on the cylinder holder body side is formed by at least one toothing arc segment having the toothing circle radius, and the toothing on the base plate side is formed by at least one toothing arc segment, in particular a closed toothing ring, having the toothing circle radius.

14. The cylinder holder of claim 13 wherein the cylinder holder body comprises a round bottom plate which is received within an interior of the toothing ring.

15. The cylinder holder of claim 11 wherein the toothings are Hirth couplings.

16. The cylinder holder of claim 11 wherein, in addition to the base plate arranged on the third face, a second base plate is arranged on a face opposite the third face, and the second base plate is fixed to the cylinder holder body at a predetermined angle with an anti-rotation lock unit, the anti-rotation lock unit comprising a projection which is arranged on one of the third face of the cylinder holder body and the base plate and is not rotationally symmetrical about an anti-rotation lock axis, and an opening which geometrically corresponds to the projection and is arranged on the other of the cylinder holder body and the base plate, the projection being received in the opening at the predetermined angle.

17. A hydroforming device comprising:

a cylinder holder according to claim 11.

18. A hydroforming device comprising:

a cylinder holder according to claim 1.

* * * * *